United States Patent [19]

Peterson et al.

[11] 4,048,952

[45] Sept. 20, 1977

[54] DIRECT RIBBON INKING BY GRAVURE

[75] Inventors: Glenn E. Peterson, Carle Place; Robert T. Emerson, Manhasset; William J. Schoenlein, Levittown, all of N.Y.

[73] Assignee: Columbia Ribbon & Carbon Mfg. Co., Inc., Glen Cove, N.Y.

[21] Appl. No.: 676,301

[22] Filed: Apr. 12, 1976

[51] Int. Cl.[2] ..... B05C 11/00; B05C 11/04; B05C 1/08

[52] U.S. Cl. ..... 118/6; 118/9; 118/33; 118/246; 118/261; 197/171

[58] Field of Search ..... 118/6, 9, 33, 246, 261, 118/7; 427/141, 428; 101/332, 336; 197/171

[56] References Cited

U.S. PATENT DOCUMENTS

| | | | |
|---|---|---|---|
| 2,797,171 | 6/1957 | Fralish | 118/33 X |
| 3,209,725 | 10/1965 | Besenick | 197/171 X |
| 3,468,700 | 9/1969 | Long | 427/428 |
| 3,602,191 | 8/1971 | Gorton, Jr. | 118/6 |
| 3,603,283 | 9/1971 | Anderson et al. | 118/6 |
| 3,788,271 | 1/1974 | Carpenter et al. | 118/33 |
| 3,840,419 | 10/1974 | De Keyser et al. | 427/428 |
| 3,862,553 | 1/1975 | Schwemmer | 118/6 X |
| 3,885,518 | 5/1975 | Varni | 118/6 |
| 3,931,786 | 1/1976 | Teed | 118/6 |
| 3,983,837 | 10/1976 | Francis | 118/7 |

FOREIGN PATENT DOCUMENTS

| | | | |
|---|---|---|---|
| 2,012,107 | 9/1971 | Germany | 427/428 |

*Primary Examiner*—James Kee Chi
*Attorney, Agent, or Firm*—Thomas L. Tully

[57] ABSTRACT

A novel inking method and apparatus particularly well suited for the re-inking of used fabric ribbons such as of the chain-printer type. The apparatus preferably contains means for moving a fabric ribbon through an inking station onto a take-up roll, means in advance of the inking station for adjusting the edge-alignment of the ribbon, embossed or gravure inking means for supplying ink directly to the ribbon without compression of the ribbon, illumination means to facilitate the inspection of the ribbon for flaws and for uniformity of ink, and shut-off means for stopping the movement of the ribbon at any desired position.

8 Claims, 5 Drawing Figures

DIRECT RIBBON INKING BY GRAVURE

The present invention is primarily concerned with the problems encountered in connection with the re-inking of relatively wide cloth ribbons known as chain-printer ribbons or line-printer ribbons used on line-printers in conjunction with computers. Ribbons of this type are relatively expensive and must be replaced frequently because the speed of operation of the line-printers on which they are used causes a relatively rapid exhaustion of the ink from the ribbon.

Currently there are machines in use for the re-inking of used chain-printer ribbons, the object being to supply fresh ink to a ribbon after each depletion as many times as possible until the condition of the cloth requires that it be discarded. Reference is made, for instance, to U.S. Pat. Nos. 3,731,649, 3,733,211 and 3,885,518 which disclose different methods and devices for re-inking used ribbons.

Among the problems involved in the re-inking of used cloth ribbons are loss of edge-alignment of the ribbon, bagging, wrinkling or loss of flatness of the ribbon, uneven distribution of ink in the re-inked ribbon and lack of inspection for flaws in the cloth prior to re-inking and for uniformity of ink after re-inking.

It is the principal object of the present invention to provide a novel improved apparatus and method especially designed for the application of ink to wide cloth webs or ribbons such as ribbons of the chain-printer or line-printer type whereby ink is applied to the cloth web or ribbon without compressing the web or ribbon during inking and without forcing a metered amount of ink into all areas of the ribbon.

It is another object of this invention to provide a novel improved apparatus and method for the re-inking of used ribbons such as chain-printer or line-printer ribbons whereby the ribbon is permitted to absorb a fresh supply of ink in amounts necessary to replace the ink which has been lost through transfer; different portions of the ribbon absorbing different amounts of ink to provide a re-inked ribbon having an ink content which is substantially uniform throughout.

It is another object of this invention to provide a ribbon re-inking apparatus with an improved edge-alignment means for correcting the alignment of the edge of a used cloth ribbon in advance of the re-inking of the ribbon in such a manner that jerky movement of the ribbon and over-correction of the alignment are avoided, thereby also avoiding creasing or wrinkling of the ribbon at the inking station.

It is yet another object of this invention to provide a ribbon re-inking apparatus having an illumination station through which a used cloth ribbon can be passed, prior to reinking, to enable the operator to inspect the ribbon for tears, holes, creases or other flaws which may render the ribbon unsuitable for re-inking, and through which the re-inked ribbon can be passed for inspection of the uniformity of the re-inking operation.

These and other objects and advantages of the present invention will be apparent to those skilled in the art in the light of the present disclosure including the drawings in which.

The objects and advantages of the present invention are accomplished by means of a novel inking method, and an apparatus for carrying out such inking method, in which an ink-absorbent web or ribbon is transported over and in direct contact with the ink-carrying surface of an embossed roll or gravure roll which is rotating at the same surface speed or at a different lesser surface speed than the web or ribbon. The web or ribbon is maintained in contact with the inking roll solely by means of tension applied to the web or ribbon and there is no backing roll or other element contacting the ribbon at the inking station to form a pressure nip which might force more ink into the web or ribbon than the web or ribbon can absorb. The amount of ink applied to the embossed roll or gravure roll is maintained uniform, such as by means of a doctor blade, and the amount of ink which is available for absorption by the web or ribbon at the inking station is varied by varying the relative speeds of the web and/or the inking roll. For intance, as the surface speed of the inking roll is reduced to speeds slower than the speed of the web or ribbon, smaller amounts of ink are made available at the inking station for absorption by the web or ribbon.

Figure 1:
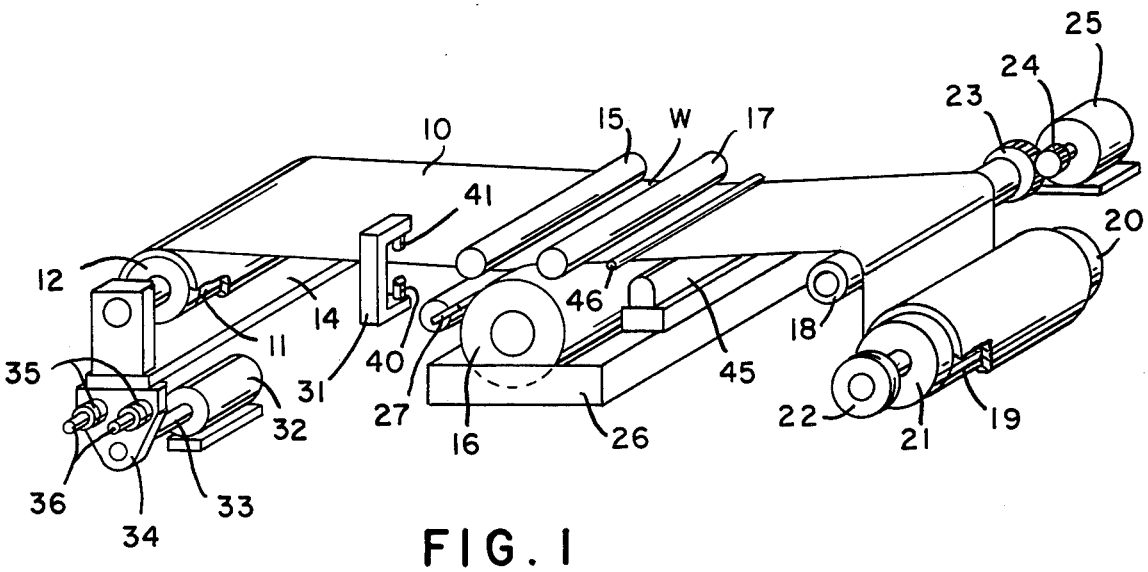
FIG. 1 is a perspective view of an apparatus according to one embodiment of the present invention illustrating a fabric web or ribbon in position during the re-inking operation.

Referring to FIG. 1 of the drawing, a fabric web or wide ribbon 10 wound on a core 11 is attached to a pair of opposed spindles 12 and 13 (not shown) mounted on a laterally-adjustable carriage 14. Spindle 12 is provided with a tension brake to maintain the expended web taut while spindle 13 is spring-loaded and adjustable to accommodate cores 11 of different lengths in tight frictional engagement.

The expended web or ribbon 10 passes beneath a first idler roll 15, wraps up and over a gravure inking roller 16 and then passes down under a second idler roll 17, over a tachometer idler roll 18 and is collected on an empty core 19 mounted on a pair of spindles 20 and 21, spindle 20 being spring-loaded and adjustable for frictional engagement with cores of various lengths and spindle 21 being provided with a pulley 22 for engagement with a motor-driven belt to pull the web or ribbon 10 through the apparatus.

The tachometer shaft or idler roll 18 is connected by means of gears 23 and 24 to a tachometer-generator 25 which generates a variable current depending upon the speed of rotation of roll 18.

Figure 2:
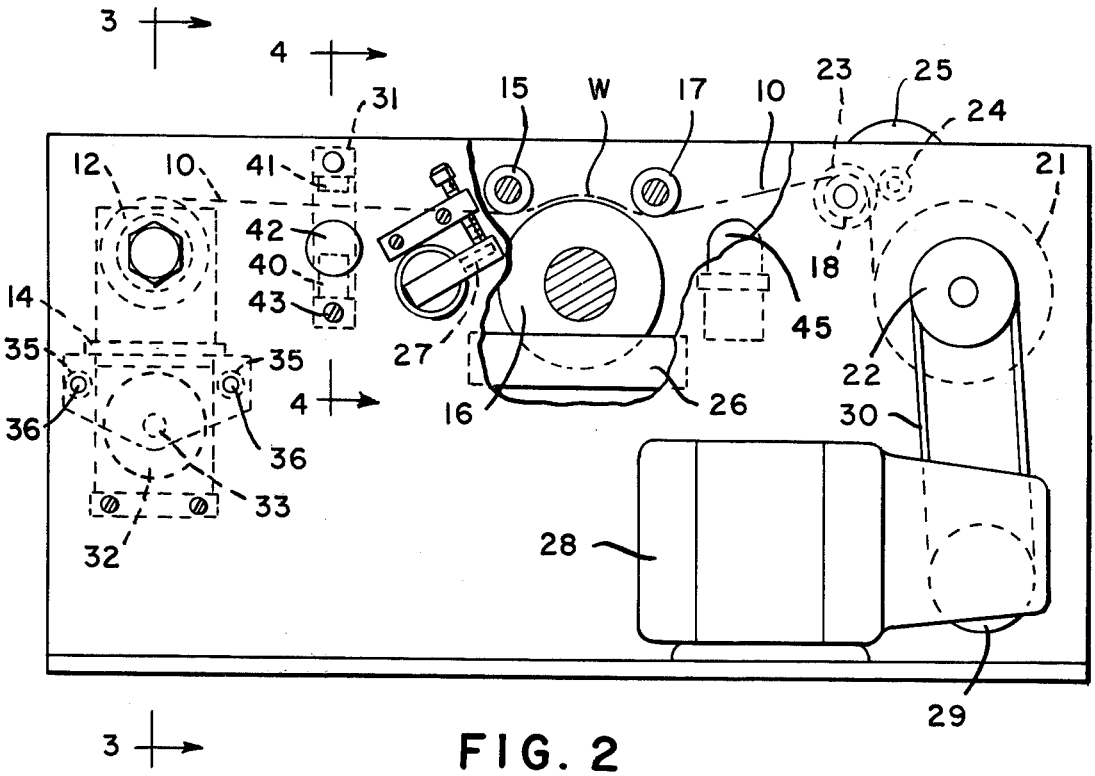
FIG. 2 is a cross-sectional side view of a ribbon re-inking machine incorporating both an edge-alignment system and an inspection station.

The inking system is the most essential feature of the present invention and involves the application of liquid ink directly to the ink-absorbent web or ribbon 10 by means of an embossed or gravure roller 16 which picks up a supply of liquid ink from an ink pan 26, has the ink supply metered by means of an adjustable doctor blade 27 and contacts a wrap W of the web or ribbon 10 as the latter passes over the ink roll 16 between the parallel idler rolls 15 and 17 which preferably are hinged at one end for ease of use. Since the idler rolls 15 and 17 are both spaced from the ink roller 16, as shown by FIG. 2, the web or ribbon 10 is not compressed but is merely maintained under tension against a significant but minor portion of the circumference of the ink roller 16, i.e., the web or ribbon 10 contacts from about 10 to about 40% of the circumference of roller 16 rather than merely making tangential contact therewith.

The ink roller 16 preferably is a conventional gravure roller having an outer surface consisting of a multiplicity of adjacent recesses or wells of uniform depth and ink capacity. Fine and coarse gravure rolls havng different ink capacities are available and the selection of an appropriate gravure roll will depend upon the type of absorbent fabric being inked, the absorbency and capacity thereof and whether the fabric is being inked for the first time or being re-inked to replace ink which has been depleted.

The direct contact between the inked gravure roller 16 and the web or ribbon 10 permits the ribbon to absorb as much ink as required to satisfy the absorbency of the web or ribbon 10. Excess ink cannot be forced into the web or ribbon 10, as can occur when the ink is applied in the nip between an ink application roller and a backing roller or pressure roller. This feature is most important in connection with the re-inking of ribbons such as chain-printer ribbons, since the residual ink contant of a used ribbon will vary substantially across the length and width of the ribbon. The used ribbon is usually worn in "tracks," i.e., the central areas of the used ribbon, which receive the direct pressure impact during the printing operation, will contain little or no residual ink while the marginal areas of the ribbon will retain a substantial amount of the original ink. Application of fresh ink in the conventional manner, i.e., in the nip between an application roller and a pressure roller, tends to force a uniform amount of ink into all areas of the ribbon whereby those portions of the used ribbon which still retained a substantial amount of the original ink will be over-inked. An over-inked ribbon will splatter or spray ink onto the copy sheet and onto the printing machinery during rapid rotation in the printing operation. Such over-inking is avoided by the present apparatus and inking method since the ribbon being re-inked is allowed to absorb fresh ink at different rates over different areas of its surface to satisfy its degree of absorbancy, which degree decreases proportionately with the amount of original ink remaining in the fabric. Thus ink application is not uniform but the ink content of the re-inked ribbon is uniform.

While the amount of ink presented to the web or ribbon 10 can be varied by the substitution of gravure ink rolls 16 of different capacities, the present invention makes it possible to accomplish this result without changing ink rolls by reducing the speed at which the ink roll rotates or by increasing the speed at which the web or ribbon 10 is drawn through the apparatus whereby the surface speed of ink roll 16 is always slower than the speed of web or ribbon 10 so that the ink roll places a drag on the web or ribbon to produce a wiping action of the ribbon as it wraps over the ink roll 16. The present apparatus preferably has variable speed means associated with the motor-driven ink roll 16 whereby the surface speed of the ink roll 16 can be varied between 1.9 times slower, 1.7 times slower and 1.5 times slower than the speed of a web or ribbon to be re-inked. The latter moves at a speed of about 80 feet per minute. The greater the speed differential the smaller will be the amount of fresh ink presented to the web or ribbon.

Most preferbly, two variable speed motors are employed, one associated with the ink roll 16 to vary the speed thereof, as discussed supra, and the other associated with the spindle 21 and pulley 22 of the web take-up roll and with the generator 25. FIG. 2 of the drawing illustrates variable speed motor 28 having a pulley 29 connected to spindle pulley 22 by means of a drive belt 30. The speed of the motor 28 and of the rotation of its drive pulley 29 is controlled by the tachometer-generator 25 and the speed of rotation of the tachometer idler roll 18, the generator 25 being connected to a variable power source for the motor 28 so that the motor speed is reduced as the speed of rotation of the tachometer idler roll 18 increases as indicated by the signal received from the generator 25. The purpose of this arrangement is to prevent the normal increase in web speed which would occur due to the increased thickness of the web collected on core 19. The uniformity of the inking operation is dependent upon a substantially-uniform speed of the web as it contacts the ink roller 16, and such a uniform speed is provided by the embodiment illustrated by FIGS. 1 and 2 of the drawing.

The present apparatus preferably is also provided wth an edge guide system which enables a used web or ribbon to be placed in perfect edge-alignment prior to the re-inking operation. Generally a used ribbon will be out of edge-alignment and will develop wrinkles and areas of unequal stress if it is passed through a re-inking apparatus in this condition.

Figure 3:
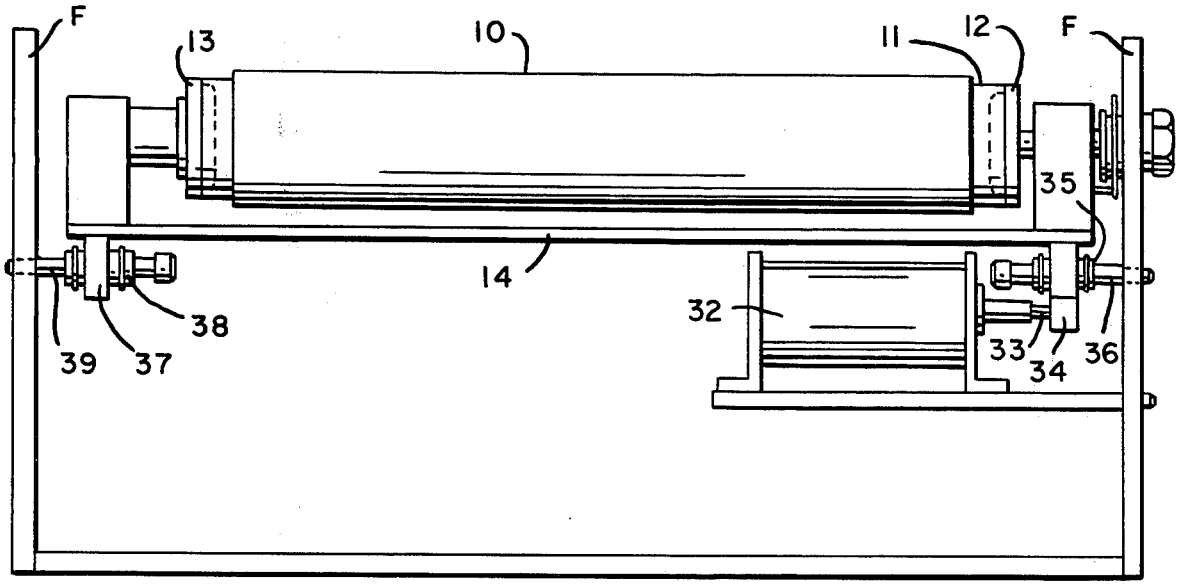
FIG. 3 is a cross-sectional end view of the apparatus of FIG. 2 taken along the line 3—3 and illustrating the ribbon core-supporting spindle carriage, its support and the activating solenoid.

The edge-alignment system of the present inking apparatus as shown in FIGS. 1 to 4 of the drawing, comprises a photoelectric edge sensor 31 which is associated with an electroproportional bi-directional D.C. solenoid 32 such as a Ledex LB-22 dual coil solenoid having a bi-directional core or piston 33 connected to the adjustable carriage 14 supporting the ribbon core 11 carrying the wound ribbon 10. As shown by FIG. 3, the solenoid 32 is fixed to the frame F of the apparatus and the piston 33, which has the ability to travel $\pm 0.25$ inch, is connected to sliding mount 34 having twin sleeves 35 which movably support the carriage 14 on twin support shafts 36 fixed to the frame. The other end of the carriage 14 also is provided with a sliding mount 37 containing twin sleeves 38 which movably support the carriage 14 on twin support shafts 39. As can be seen, movement of piston 33 in or out will cause the attached carriage 14 to move in a corresponding direction.

Figure 4:
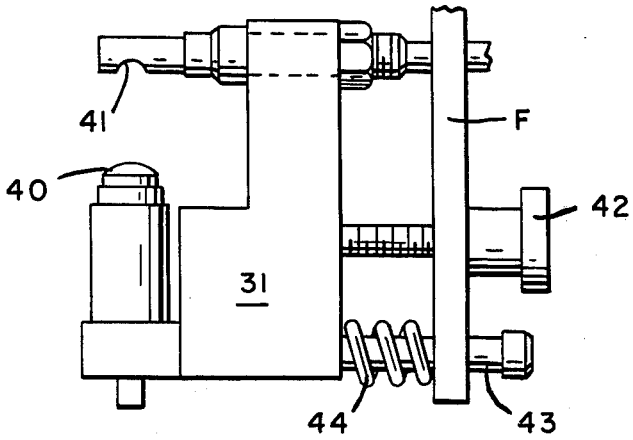
FIG. 4 is a cross-sectional end view of a portion of the apparatus of FIG. 2 taken along the line 4—4 and illustrating the photocell device of the edge-alignment system.

The photoelectric edge sensor 31, more clearly illustrated by FIG. 4, comprises a light source 40 and a photocell 41 spaced directly thereover to provide a passage adapted to admit the edge of the web or ribbon 10. The sensor 31 is attached to the frame F of the apparatus by means of knob bolt 42 and shoulder bolt 43 and spring 44, and its position is adjustable to accommodate webs or ribbons of different widths.

Figure 5:
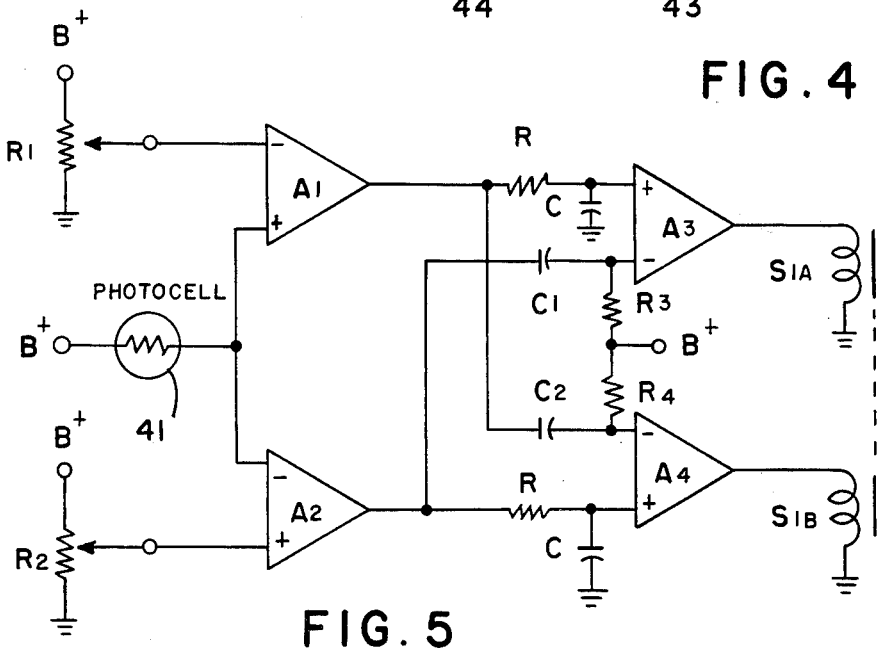
FIG. 5 is a schematic view of the electric circuit for the edge-alignment system of the present apparatus.

Referring to FIG. 5 of the drawing, the photocell 41 of sensor 31 is connected to operational amplifier comparators A1 and A2, to the non-inverting input of A1 and to the inverting input of A2. A suitable component for the purpose is a Motorola MC-1458 dual opertional amplifier. The threshold points of A1 and A2 are independently adjustable by potentiometers R1 and R2. R1 and R2 are adjusted to produce a narrow "dead" band, a level of illumination on the photocell which produces no output from either A1 or A2. This "dead" band corresponds to the level of illumination on the photocell when the edge of a web or ribbon covers one-half of the light beam passing between light source 40 and photocell 41.

When photocell illumination increases, i.e., when the edge of the web or ribbon moves outwardly from the center of the light beams, A1 produces a positive output. Conversely, when photocell illumination decreases, i.e., when the edge of the web or ribbon moves inwardly from the center of the light beam to block or shade more than one-half thereof, comparator A2 produces a positive output.

The pulse outputs of A1 and A2 are slope-modified by R-C integrating networks and coupled to output amplifiers A3 and A4 which in turn feed opposing coils S1A and S1B of the bidirectional solenoid 32.

In operation, the web or ribbon 10 and the sensor 31 are adjusted so that the edge of the ribbon 10 extends between light source 40 and photocell 41 to block or shade about one-half of the light beam therebetween, corresponding to the aforementioned dead band, to provide the centered position of the web or ribbon 10. The leading edge of the ribbon 10 is attached to core 18 on motor-driven spindles 19 which are activated to draw the ribbon through the apparatus at a speed of about 80 feet per minute to obtain edge-alignment. This may be done prior to the inking operation if desired whereby the ribbon may be aligned onto core 18 and then core 18 and original core 11 may be interchanged so that the passage of the aligned ribbon from core 18 through the inking operation causes the re-inked ribbon to be collected on its original core 11. This procedure is required for ribbons such as chain-printer ribbons which have an ink-free leader or other attachment at the start of the ribbon.

During passage of the ribbon 10 through the sensor 31, no activation of the solenoid 32 occurs if the ribbon is in perfect edge-alignment. However if the ribbon is out of alignment the ribbon edge will modify the illumination of photocell 41. This will produce a positive output by either comparator A1 (increase) or A2 (decrease) which will be ampliifed by A3 or A4 respectively and fed to coil S1A or S1B respectively.

Energizing of coil S1A by A1 and A3 causes the piston 33 of solenoid 32 to move outwardly from the solenoid to push the supporting carriage 14 laterally towards the side of the apparatus supporting the sensor 31 whereby the web or ribbon 10 is moved inwardly so that the edge thereof blocks or shades more of the photocell beam to return the web to centered position within the dead band of the sensor 31, deenergizing coil S1A.

Energizing of coil S1B by A2 and A4 causes the piston 33 of solenoid 32 to retract into the solenoid and to pull the supporting carriage 14 laterally away from the side of the apparatus supporting the sensor 31 whereby the web or ribbon 10 is moved outwardly so that the edge thereof uncovers more of the photocell beam to return the web to centered position within the "dead" band of the sensor 31, deenergizing coil S1B.

The electrical circuit of FIG. 5 also illustrates the presence of cross-coupling networks C1-R3 and C2-R4 between the A1-S1A circuit and the A2-S1B circuit. Such a coupling has been found to be necessary as a means for preventing the carriage 14 from overshooting centered position as a result of its inertia during adjustment. Without the cross-coupling the carriage 14 will overshoot considerably due to its inertia and the carriage will be constantly undergoing oscillating lateral movements which jerk the web or ribbon from side to side and can cause it to crease or wrinkle.

The cross-coupling networks provide a means for damping such unwanted oscillation without slowing the response of the system. In operation, when A2 and A4 turn off coil S1B is deenergized. C1 and R3 couple the negative-going trailing edge of the pulse from A2 to output amplifier A3 where it is inverted, amplified and applied to opposing coil S1A as energy to stop the movement of the piston 33 and the carriage 14.

In like manner the turn-off of A1-A3 and deenergizing of coil S1A after correction simultaneously causes opposing coil S1B to receive a pulse coupled to A4 by C2-R4 and provide a braking action for the piston 33 and carriage 14. This bi-directional braking action permits the web or ribbon 10 to be brought into perfect edge-alignment with a minimum amount of movement of carriage 14 and without slowing the response of the carriage 14 to signals received from the sensor 31.

The present apparatus also preferably includes an inspection light as shown in FIG. 1 of the drawings. Light 45 comprises a conventional fluorescent lamp assembly which is attached to the frame of the apparatus at a location beyond the inking station and beneath the web or ribbon 10, the lamp facing the ribbon 10 and being at least as long as the ribbon is wide. The inspection light 45 serves two purposes. In the case of used ribbons which are to be re-inked, it is preferred to initially pass the ribbon through the edge-alignment sensor 31 and over the inspection light 45 without engagement in the inking station so that the ribbon can be aligned and inspected for holes or other defects which may render the ribbon unsuitable for re-inking. If the ribbon is suitable for re-inking, the core 18 carrying the inspected ribbon is interchanged with the original core 11 and the ribbon is transported through the apparatus in engagement under the parallel idler rolls 15 and 17 and over the gravure inking roll 16. After passing the inking station the ribbon passes over the inspection light 45 so that a final inspection can be made regarding the visible uniformity of ink content and the absence of wrinkles and other defects.

The present apparatus and method also includes means for automatically stopping movement of the web or ribbon 10 at any desired point, generally a short distance from the end of the web or ribbon to prevent the ribbon from losing engagement with the supply core and losing tautness. As shown by FIG. 1 such means comprises an activator bar 46 which is a lightweight metal bar which is attached to the ribbon at the desired location and is sufficiently long to extend beyond the edge of the ribbon 10 which passes the photoelectric sensor 31. Preferably the bar 46 is attached to the ribbon at the desired location during the initial alignment and inspection of the ribbon. Thus when the ribbon is passed during the inking cycle the bar 46 will be in position to stop the apparatus prior to the separation of the ribbon from its core.

The activator bar 46 functions by interposing a complete and abrupt interference with the light passing between light source 40 and photocell 41. The photocell 41 is connected to the power supply for the apparatus whereby an abrupt and complete interference with the photoelectric light beam disconnects the power supply and stops the apparatus.

Variations and modifications may be made within the scope of the claims and portions of the improvements may be used without others. 9n

We claim:

1. An apparatus for the application of sufficient amounts of liquid printing ink to a used printing ribbon, comprising an ink-absorbent fabric web containing an unveven distribution of residual printing ink, to provide said fabric web with an even, uniform impregnation of printing ink, comprising a web-supply roll, an ink-applicator roll having a gravured surface, and a web-windup roll, means for transporting under tension a continuous length of a used printing ribbon, comprising an ink-absorbent fabric web containing an uneven distribution of residual printing ink, from said supply roll, over a portion of the gravured surface of said applicator roll and onto said windup roll, means for turning said applicator roll in the same direction as said web is transported but at a surface speed which is slower than the speed of said web so as to place a drag thereon, means for supplying liquid printing ink to the gravured surface of said applicator roll, blade means associated with the inked gravured surface of said applicator roll for removing said liquid printing ink from the surface of said applicator roll except for ink within the recesses of said gravured surface, and means for maintaining said ink-absorbent fabric web in compression-free contact with the inked gravured surface of said applicator roll whereby said ink-absorbent fabric web is free to absorb said liquid printing ink from the recesses of said applicator roll in different amounts across the width of said web to satisfy the different degrees of ink-absorbency of said web, as determined by the different amounts of residual ink remaining within different areas of said web, to provide said web with a uniform, even impregnation of said liquid printing ink.

2. An apparatus according to claim 1 which also includes web-alignment means comprising photoelectric sensing means adapted to sense the edge of said web during transport from said supply roll to said windup roll, laterally-movable carriage means supporting said supply roll independently of said windup roll, position-adjustment means comprising a bidirectional solenoid having a movable piston connected to said carriage means and adapted to move said carriage means laterally in either direction in response to an electrical signal from said sensing means and means connecting said sensing means and said adjustment means whereby variations in the position of the edge of the web during transport, relative to said sensing means, will cause said sensng means to emit an electric signal to said solenoid to cause said piston to move said carriage laterally in the proper direction to correct the position of the edge of the web relative to the sensing means.

3. An apparatus according to claim 2 in which said photoelectric sensing means is also connected to the power source for the apparatus and is adapted to cut off the power and stop the machine in response to an abrupt and complete photoelectric interference as may be caused by an attachment to the web at a desired location.

4. An apparatus according to claim 2 in which said means connecting said sensing means and said adjustment means includes a cross-coupling electrical circuit for stopping the lateral movement of said carriage after each adjustment.

5. An apparatus according to claim 1 in which said means for transporting said web comprises a variable speed motor associated with said web-windup roll.

6. An apparatus accordng to claim 5 which comprises means for sensing the speed of the web being transported and means associated with said sensing means and with said variable speed motor for adjusting the speed of said motor and of said web-windup roll to maintain the speed of said web substantially uniform.

7. An apparatus according to claim 1 which also comprises an inspection light which is adapted to underlie the web and be visible therethrough to provide means for assisting the visual inspection of the web for defects and for uniformity of ink content.

8. An apparatus according to claim 1 which comprises means for transporting a continuous length of ink-absorbent fabric in a direction substantially tangential to the ink-applicator roll, and two parallel bars spaced from said applicator roll, one on each side thereof, for deflecting the path of said length of fabric and causing said length of fabric to wrap around from about 10% to about 40% of the circumference of said applicator roll.

* * * * *